US006318108B1

(12) United States Patent
Holstein et al.

(10) Patent No.: US 6,318,108 B1
(45) Date of Patent: Nov. 20, 2001

(54) SELF-WASHING COIL FOR AIR CONDITIONING UNITS

(76) Inventors: George L. Holstein, 29 Peninsula Ct., Bear, DE (US) 19701; George R. Tracey, Jr., 221, Paul Pl., Runnemeade, NJ (US) 08078

( * ) Notice: Subject to any disclaimer, the term of this patent is extended or adjusted under 35 U.S.C. 154(b) by 0 days.

(21) Appl. No.: 09/670,885

(22) Filed: Sep. 27, 2000

(51) Int. Cl.[7] ..... F25B 47/00
(52) U.S. Cl. ..... 62/279; 62/280
(58) Field of Search ..... 62/279, 280, 183

(56) References Cited

U.S. PATENT DOCUMENTS

| | | | | |
|---|---|---|---|---|
| 1,978,555 | | 10/1934 | Snow . | |
| 2,349,059 | | 5/1944 | Terry et al. . | |
| 3,811,293 | | 5/1974 | Flynn . | |
| 3,828,570 | | 8/1974 | Stutz . | |
| 4,332,292 | | 6/1982 | Garberick . | |
| 4,375,752 | | 3/1983 | Stocking et al. . | |
| 4,566,890 | | 1/1986 | Hostler et al. . | |
| 4,666,531 | | 5/1987 | Minard . | |
| 4,705,057 | | 11/1987 | Mohr et al. . | |
| 4,884,416 | | 12/1989 | Hwang . | |
| 5,113,668 | | 5/1992 | Wachs, III et al. . | |
| 5,117,644 | * | 6/1992 | Fought | 62/171 |
| 5,156,018 | | 10/1992 | Kobayashi et al. . | |
| 5,186,240 | | 2/1993 | Kennon et al. . | |
| 5,226,285 | | 7/1993 | Dankowski . | |
| 5,279,357 | | 1/1994 | Kennon et al. . | |
| 5,336,331 | | 8/1994 | Jenkins . | |
| 5,337,580 | | 8/1994 | Zhao et al. . | |
| 5,461,879 | | 10/1995 | Bolton et al. . | |
| 5,605,052 | * | 2/1997 | Middleton et al. | 62/171 |
| 5,682,757 | | 11/1997 | Peterson . | |
| 5,879,466 | | 3/1999 | Creger et al. . | |
| 6,070,423 | * | 6/2000 | Hebert | 62/280 |

* cited by examiner

*Primary Examiner*—William E. Tapolcal
*Assistant Examiner*—Mohammad M. Ali
(74) *Attorney, Agent, or Firm*—Connolly Bove Lodge & Hutz LLP

(57) ABSTRACT

An air conditioning system includes an exterior condenser having a heat exchange coil. Spray head structure on the condenser is arranged to spray water from a water supply onto the heat exchange coil. A control device periodically energizes the water supply whereby water is supplied to the spray head and onto the exchange coil to clean and cool the coil. The water supply may comprise a condensate reservoir and pump assembly, and conduit for delivery of condensate from the drain of an interior evaporator to the reservoir. Alternatively, the water supply may comprise tap water under pressure. When condensate is used, tap water under pressure may serve as a supplemental supply to the reservoir.

7 Claims, 13 Drawing Sheets

SELF-WASHING COIL FOR AIR CONDITIONING UNITS

BACKGROUND OF THE INVENTION

This invention relates generally to vapor compression air conditioning systems, and more particularly to improved system efficiency related to the exterior heat exchange coil by cleaning and cooling the coil.

Typical refrigeration systems include a compressor, a motor adapted for driving the compressor, a condenser in fluid communication with the compressor, an expansion device in fluid communication with the condenser and an evaporator in fluid communication with the expansion device. Refrigeration systems of this type used for air conditioning and dehumidification remove moisture from the air at the evaporator. The moisture condensed at the evaporator is called condensate and is essentially distilled water.

In an air conditioning system of the aforementioned type, waste heat is transferred to the outside environment at the condenser through use of a heat exchange coil. This coil is comprised of a plurality of refrigerant tubes connected to and supported by metal fins. These metal fins aide in the heat dissipation from the refrigerant. This heat exchange is normally aided by a fan designed to force ambient air past the heat exchange coils and fins.

After a period of service the heat exchange coil and fins accumulate dust, dirt and foreign matter that act as an insulative coating. This coating restricts the flow of heat between the refrigerant inside the coils and the air flowing past the coils and fins. The result is that the overall system efficiency is degraded.

A second problem which arises when the heat exchange coils and fins become and remain coated with foreign matter is corrosion on the surface that further insulates and restricts the flow of heat. This is a particular problem in coastal areas where ocean salts accumulate on the metal coils and fins.

When in service in proximity to a manufacturing or industrial facility, air conditioning heat exchange coils tend to accumulate a coating of materials being dispersed into the air by the manufacturing process. Industrial by-products such as paper pulp and coal ash will form a thick layer on exposed coils and fins, sometimes completely blocking the air flow through the coil.

Air conditioner manufacturers specify regular coil cleanings as part of a system's maintenance program. In practice, however, the exterior heat exchange coil seldom receives any attention until a breakdown occurs or system efficiency degrades to a noticeable degree. At that point the system has been operating inefficiently for some time, wasting energy and corrosion may already have had a permanent effect on the surface of the coils and fins.

For these and other reasons it is desirable to clean the exterior condenser heat exchange coil frequently.

The industry has long dealt with condensate water as purely a waste product and has many methods and apparatus for its disposal. In many residential installations condensate is simply piped into a French drain, sump pump or floor drain. The constant source of standing water in a house can cause or irritate existing health problems related to mold allergies.

The Environmental Health Center, a Division of the National Safety Council, says that exposure to molds "may trigger allergic reactions, including hypersensitivity to pneumonia, allergic rhinitis and some types of asthma."

They also state that "some molds and mildews can release disease causing toxins. These toxins can damage a variety of organs and tissues in the body, including the liver, central nervous system, digestive system and immune system. Some diseases, like humidifier fever, can be traced to microorganisms that grow in home heating and cooling systems." They recommend relative humidity levels between 30% and 50% to help prevent mold growth.

Some other residential installations deal with the waste condensate by piping it into the building's sanitary sewer drain. Some municipalities (example: Burlington County, N.J.) have banned this practice stating the increased load it places on waste water treatment facilities.

Roof mounted commercial air conditioners deal with waste condensate by dumping it directly onto the roof. This practice on buildings with flat roofs frequently produces pools of standing water that increase roof leaking problems and provide breeding grounds for harmful insects.

Some inventions have detailed different methods of condensate disposal. U.S. Pat. No. 5,461,879 illustrates a method of condensate removal by splashing the water from a collection tray onto the condenser coil from the inside for evaporation. This and other inventions of its type concentrate merely on getting rid of the waste water without deriving much benefit from its use.

U.S. Pat. No. 5,682,757 describes a method of piping condensate water to specific mechanical and electrical components of the air conditioning system for direct cooling of said components. This invention requires that the condensate piping be built into the air conditioner at its manufacture and therefore cannot be retro-fitted to existing units. It also does not deal with cleaning the exterior condenser heat exchange coil.

Still some other patents describe apparatus for cleaning the coils of window mounted air conditioners such as U.S. Pat. No. 4,884,416. Again these devices are designed to be included in the air conditioner at its manufacture and cannot easily be retro-fitted to existing units. Still another problem with these devices is the large number of moving parts required for their operation. This, it seems, would provide another step in the routine maintenance of the air conditioning unit.

SUMMARY OF THE INVENTION

It is therefore one of the principal objects of the present invention to provide a cleaning device and system which can be used to clean the surfaces of air conditioner condenser heat exchange coils, to remove dirt and other contaminants therefrom and which can be permanently installed to provide frequent, regular cleaning of the coils and fins before dirt accumulation and subsequent damage becomes significant.

Some of the objects and advantages of the present invention are:

(a) to provide a system/mechanism which will improve the system efficiency of air conditioning units by frequently washing the condenser heat exchange coil;

(b) to provide a system/mechanism which will reduce the amount of manual attention required to properly maintain an air conditioning unit;

(c) to provide a system/mechanism which will increase the useful life of an air conditioning unit;

(d) to provide a system/mechanism which will reduce the power demand of the air conditioner compressor during a washing cycle;

(e) to provide a system/mechanism which will reduce the power demand of the air conditioning unit over its service life;

(f) to provide a system/mechanism that will help improve interior air quality;

(g) to provide a system/mechanism that will reduce the volume of waste water deposited into municipal sewage systems;

(h) to provide a system/mechanism that can be installed as a retro-fit onto existing, in-service air conditioning units;

(i) to provide a system/mechanism that can be installed onto various designs and styles of air conditioning condenser coil cases without modification of the case; and (j) to provide a system/mechanism that is inexpensive to manufacture and which requires little maintenance.

In accordance with the present invention, condensate water produced by an air conditioning system is used to wash the exterior condenser heat exchange coil. This washing process has many benefits. Its primary benefit is cleaning the coil of debris. Of secondary benefit is the reduction in power consumption through evaporative cooling realized by applying water to the heat exchange coil.

BRIEF DESCRIPTION OF THE DRAWINGS

Novel features and advantages of the present invention in addition to those noted above will become apparent to persons of ordinary skill in the art from reading the following detailed description in conjunction with the accompanying drawings wherein similar reference characters refer to similar parts and in which.

DETAILED DESCRIPTION OF THE INVENTION

Figure 1:
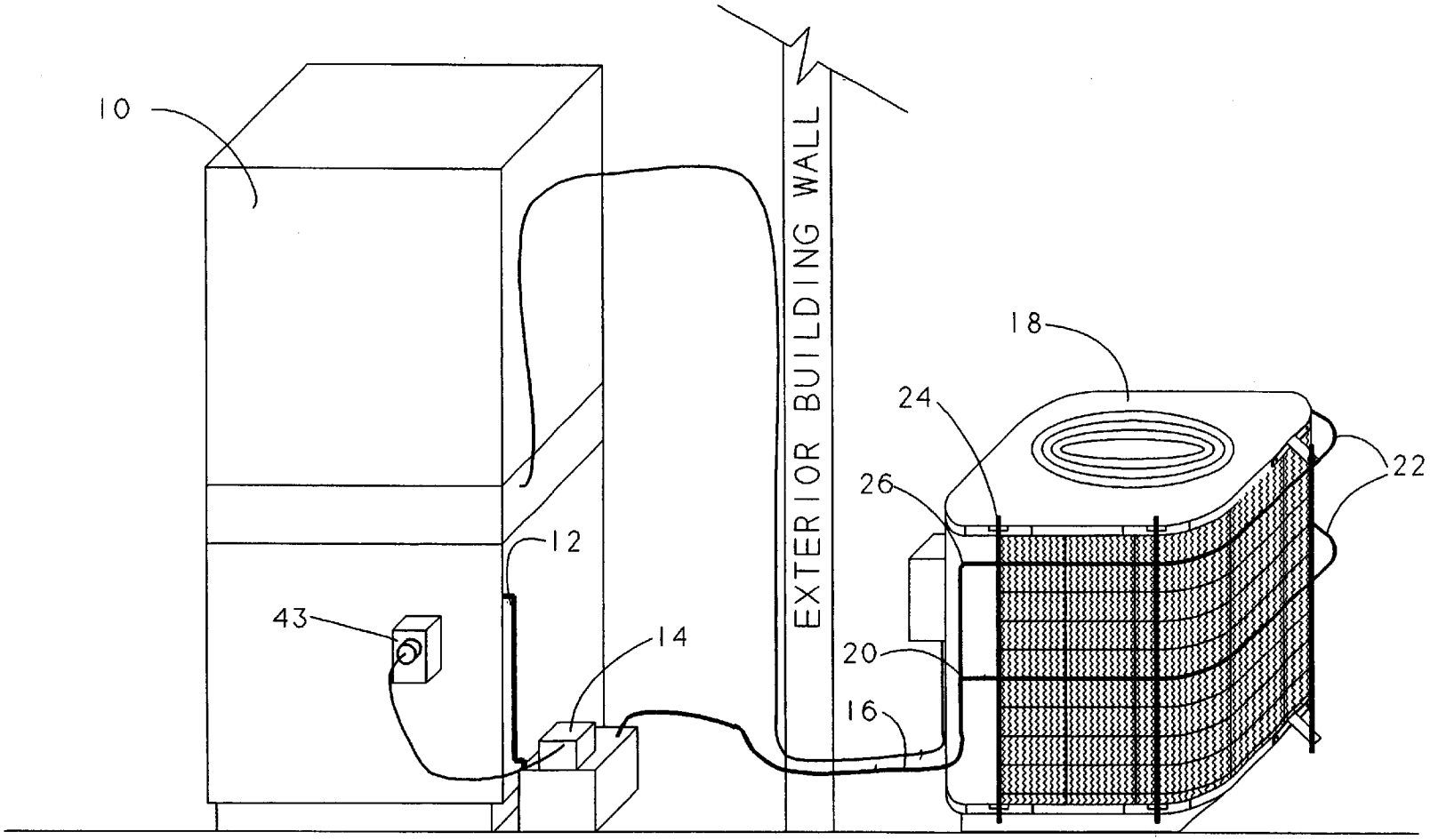
FIG. 1 is a perspective view illustrating air conditioning apparatus with a coil spray wash, according to the present invention.
Figure 2:
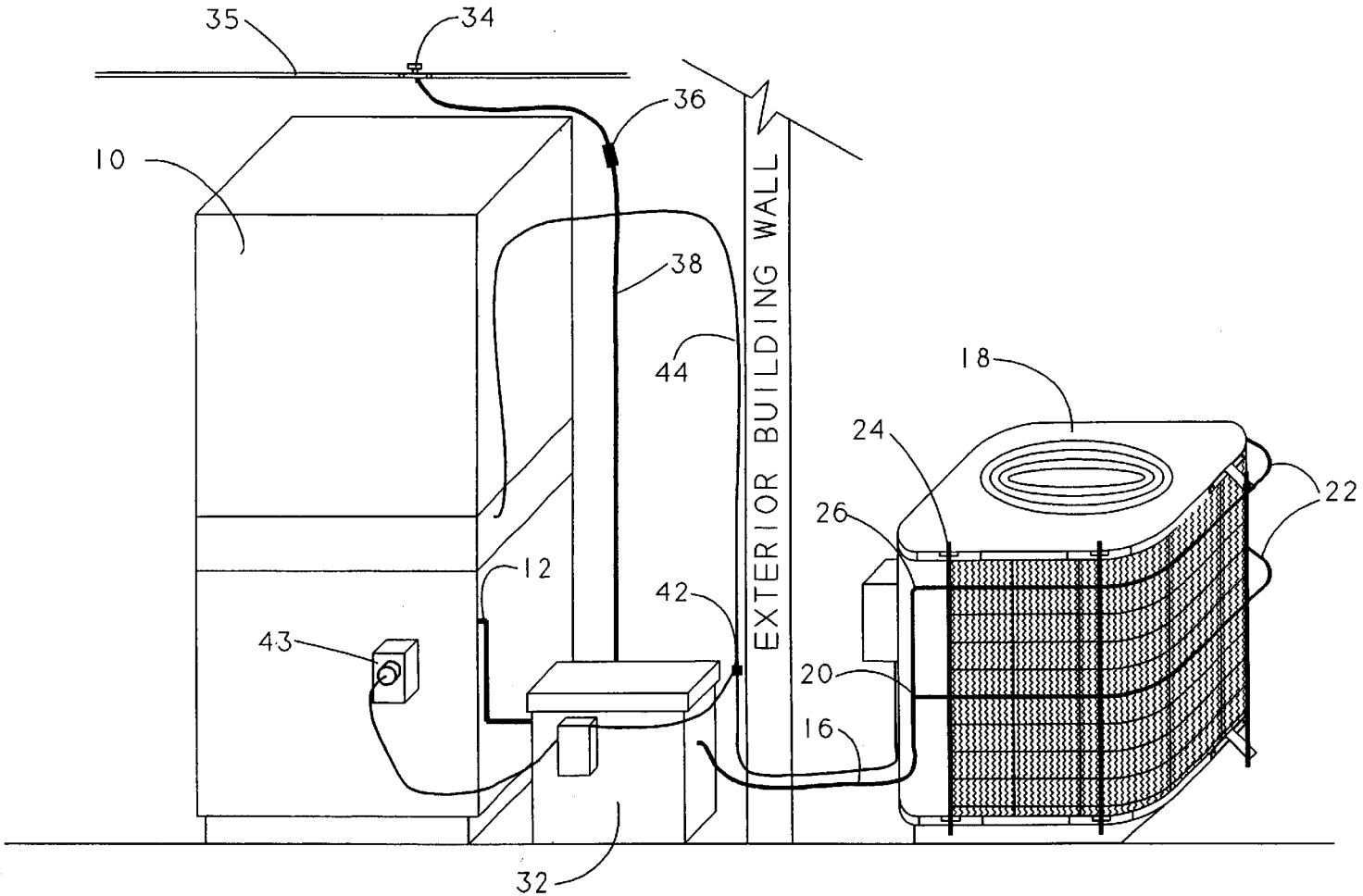
FIG. 2 is a perspective view similar to FIG. 1 showing an alternate embodiment, according to the present invention.
Figure 3:
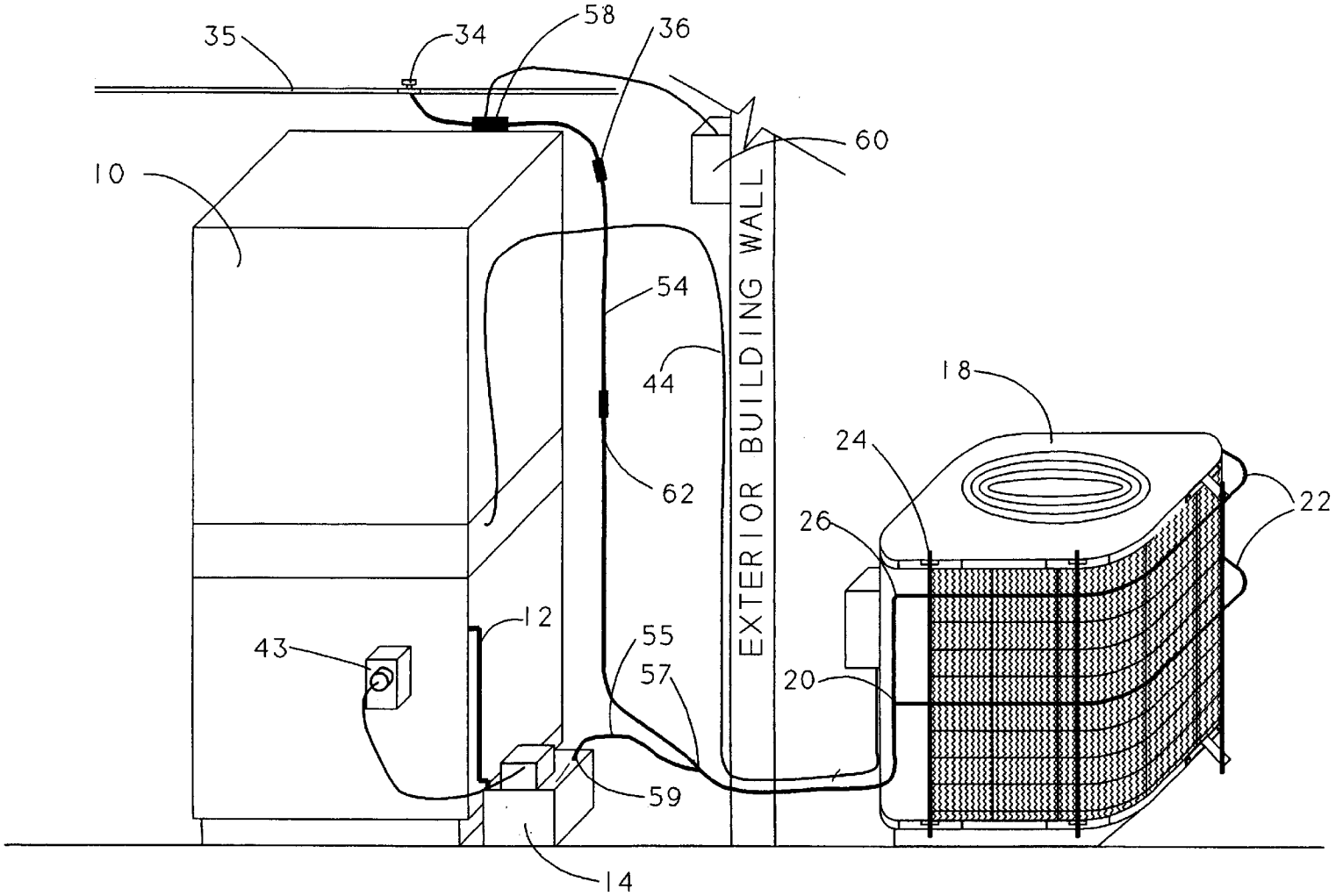
FIG. 3 is a perspective view similar to FIGS. 1 and 2 but showing a further embodiment, according to the present invention.

Three preferred embodiments of the present invention are shown in FIGS. 1, 2 and 3. Each of these three embodiments essentially serves the same function but with differing degrees of control. Each of the different embodiments may be suited for use in different air conditioning applications, as will become evident.

As shown in FIG. 1, condensate from an air handling unit 10 is conducted from an evaporator through a condensate drain 12 (all air conditioner units are equipped with this feature) to a condensate discharge pump 14. From there the condensate is pumped in ⅜" O.D. polyethylene (¼" I.D.) tubing 16 through an exterior wall of the building. Near the case of the air conditioner exterior condenser unit 18 tubing enters a ⅜" O.D. T fitting 20. Exiting the T fitting 20 is ⅜" O.D. spray-flex tubing 22. The spry-flex tubing 22 is supported by an attachment assembly 24.

Depending on the height of the exterior case a second or third row of spray-flex tubing may be needed and this is accomplished by a ⅜" O.D. 90 degrees elbow fitting 26. The spray-flex tubing 22 is terminated using a ¼" O.D. plug.

The condensate pump 14 receives electrical power from a grounded 110 volt outlet 43. As explained more fully below when the pump is activated condensate water is sprayed onto the fins and coils of the condenser 18 for cleaning and cooling purposes.

FIG. 2 illustrates an alternate embodiment where condensate from the air handling unit 10 is conducted from the evaporator through the condensate drain 12 to a condensate storage reservoir 32. From there the condensate is pumped in ⅜" O.D. polyethylene (¼" I.D.) tubing 16 through the exterior wall of the building. Exiting the T fitting 20 is ⅜" O.D. spray-flex tubing 22. The spray-flex tubing 22 is supported by an attachment assembly 24.

Depending on the height of the exterior case a second or third row of spray-flex tubing may be needed this is accomplished by a ⅜" O.D. 90 degrees elbow fitting 26. The spray-flex tubing 22 is terminated using a ¼" O.D. plug.

A self-tapping ¼" saddle valve 34 is connected to the building's domestic cold water supply tubing 35. A back-flow preventing device 36 is installed in the supplemental water supply line 38 which enters the condensate storage reservoir 32.

A temperature probe 42 is attached to the air conditioner's refrigerant liquid line 44.

The condensate storage reservoir controls receive electrical power from a grounded 110 volt outlet 43.

In this embodiment, the reservoir 32 is also supplied with domestic cold water in addition to condensate water.

FIG. 3 illustrates still another embodiment where a self-tapping ¼" saddle valve 34 is connected to the building's domestic cold water supply tubing 35. A ¼" O.D. polyethylene supply line 54 runs th rough the building's exterior wall. A back-flow preventing device 36 is install ed on water supply line 54.

An exterior mounted digital control unit 60 is connected to a solenoid valve 58 on the water supply line 54.

An adjustable flow restricting device 62 is installed on water supply line 54.

Near the case of the air conditioner exterior condenser unit 18 the tubing enters a ⅜" O.D. T fitting 20. Exiting the T fitting 20 is ⅜" O.D. spray-flex tubing. The spray-flex tubing 22 is supported by an attachment assembly 24.

Depending on the height of the exterior case a second or third row of spray-flex tubing may be needed and this is accomplished by a ⅜" O. D. 90 degrees elbow fitting 26. The spray-flex tubing 22 is terminated using a ¼" O.D. plug.

Condensate from the air handling unit 10 is conducted from the evaporator through the condensate drain 12 to a condensate discharge pump 14. From there the condensate is pumped in ⅜" I.D. polyethylene (¼" l.D.) tubing 55 which connects with water supply line 54 at "Y" connector 57. A check valve 59 is used to prevent domestic water entering the condensate pump 14 reservoir.

The condensate pump 14 receives electrical power from a grounded 110 volt outlet 43.

Figure 4:
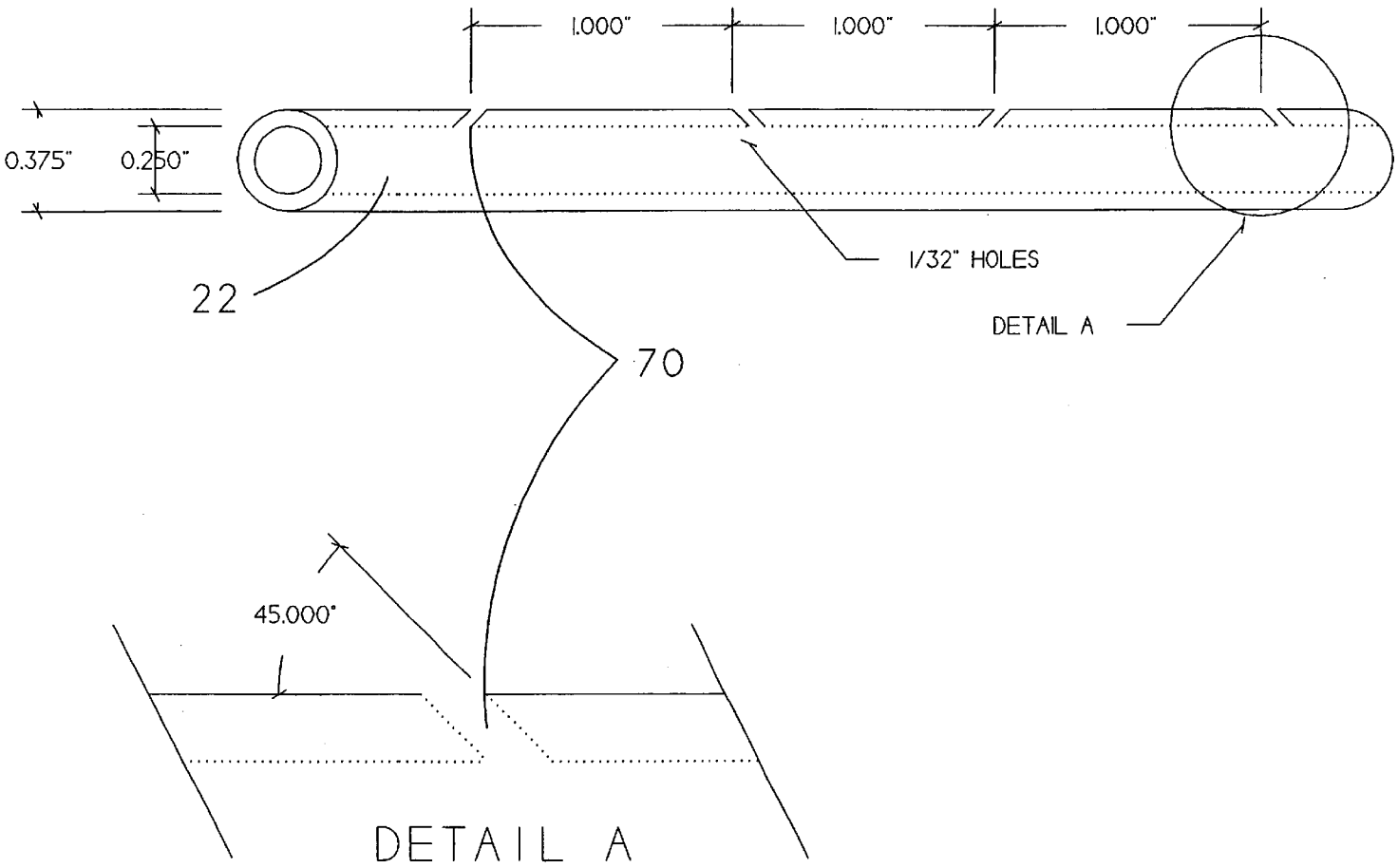
FIG. 4 shows details of spray-flex tubing, according to the present invention.

FIG. 4 shows a graphic representation of the water spray pattern produced by the spray-flex tubing 22. Alternating angles of the spray holes 70 produce uniform spray coverage at the plane of the coil surface 72 when the tubing is positioned at the optimum distance 74.

Figure 6B:
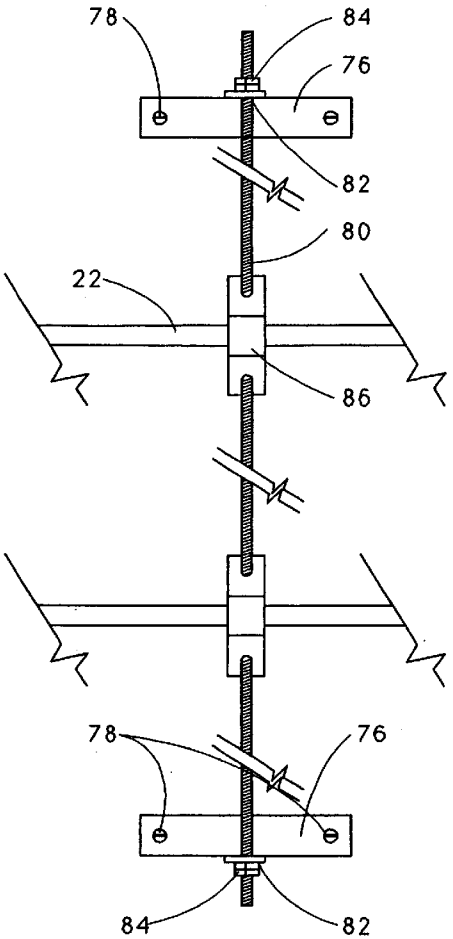
FIGS. 6A, 6B and 6C show details of the tubing attachment mechanism.
Figure 6A:
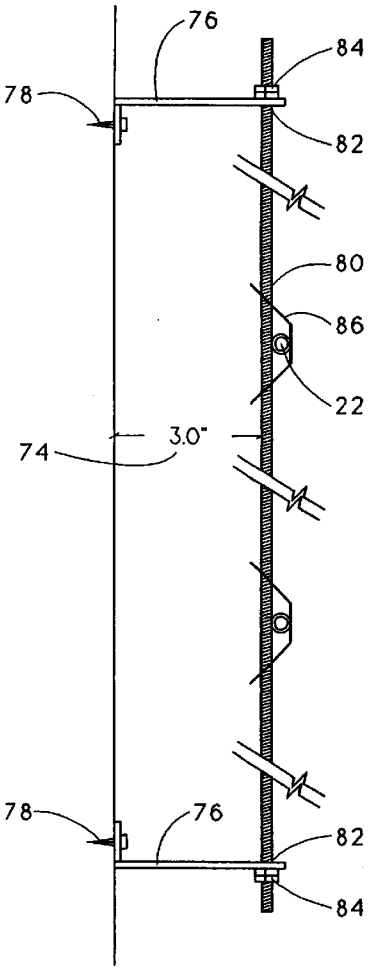
Figure 6C:
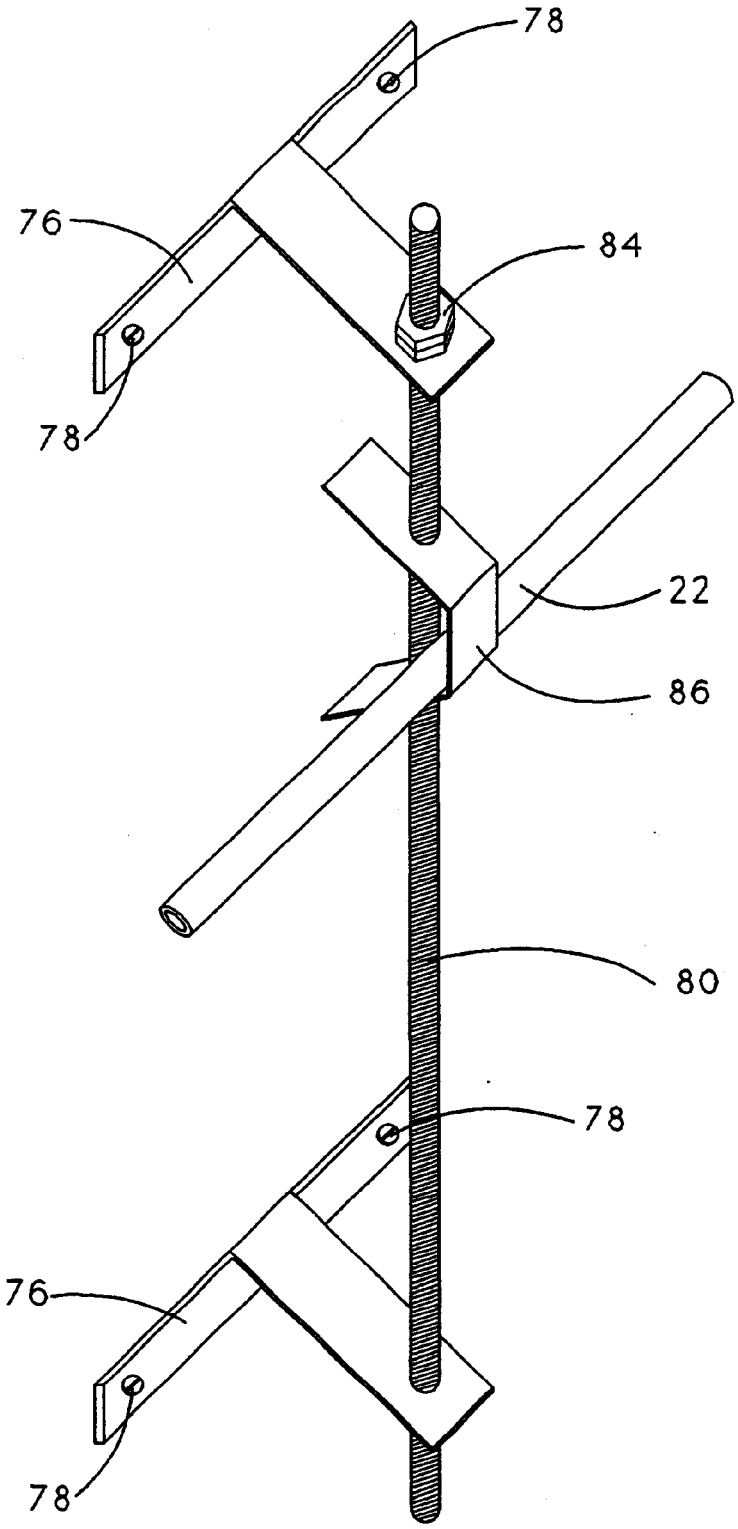

As shown in FIGS. 6A–6C, the tubing attachment mechanism 24 consists of steel angle brackets 76 attached to the exterior of the condenser heat exchange coil case at the top and bottom. The upper and lower angle brackets 76 are aligned with each other and are connected directly to the case and self tapping sheet metal screws 78.

An appropriate length of 3/16" steel all-thread rod 80 is fed through holes 82 in each bracket. Holes 82 are positioned to hold the all-thread rod 80 at the optimum distance 74 for uniform spray pattern. The all-thread rod 80 is held in place through use of standard nuts 84 at top and bottom angle brackets 76.

Spray-flex tubing 22 runs perpendicular to the all-thread 80 rod and is held in place by metal spring clips 86.

Figure 7A:
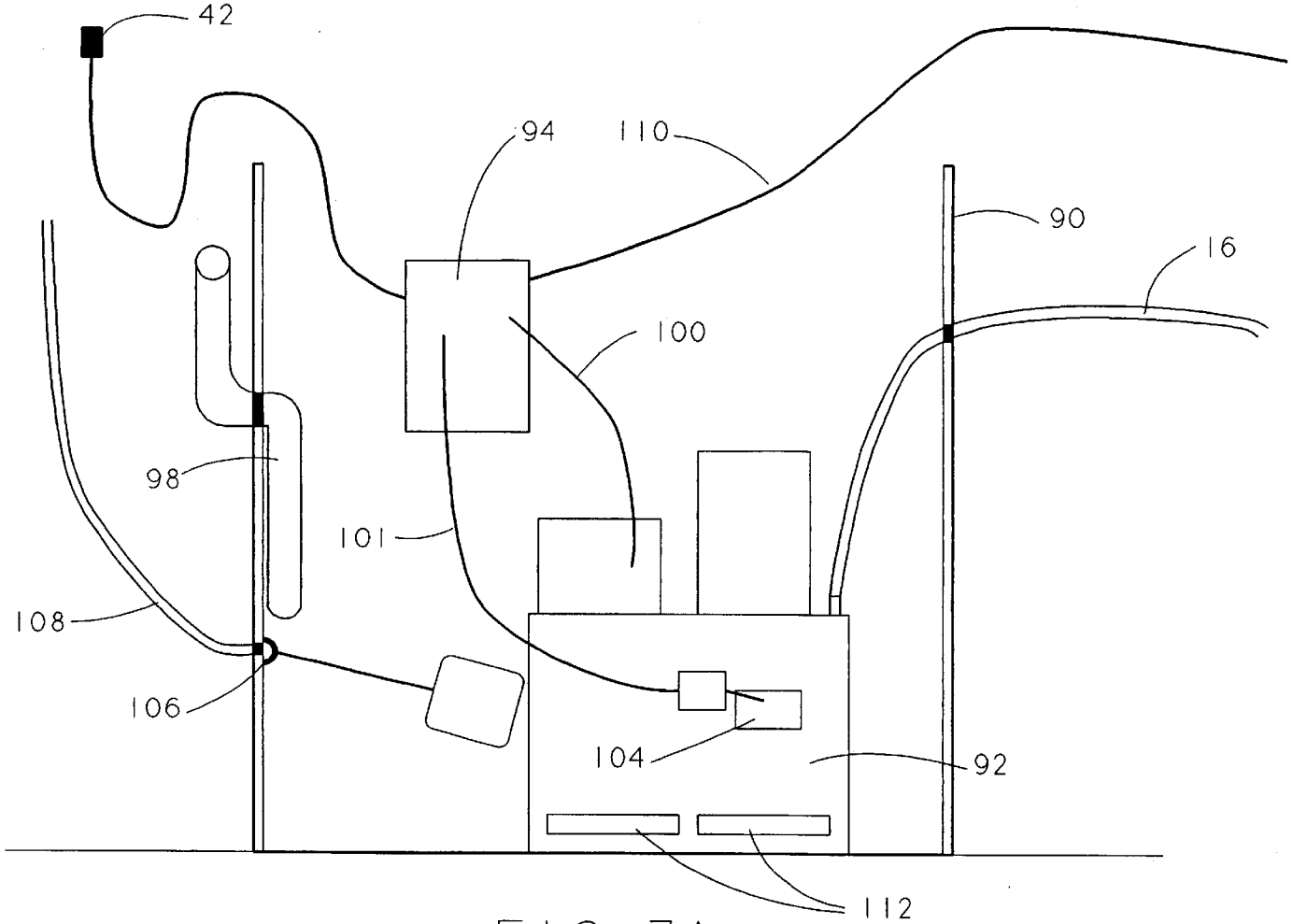
FIG. 7A, 7B and 7C show the reservoir and controls for the system of FIG. 2.
Figure 7B:
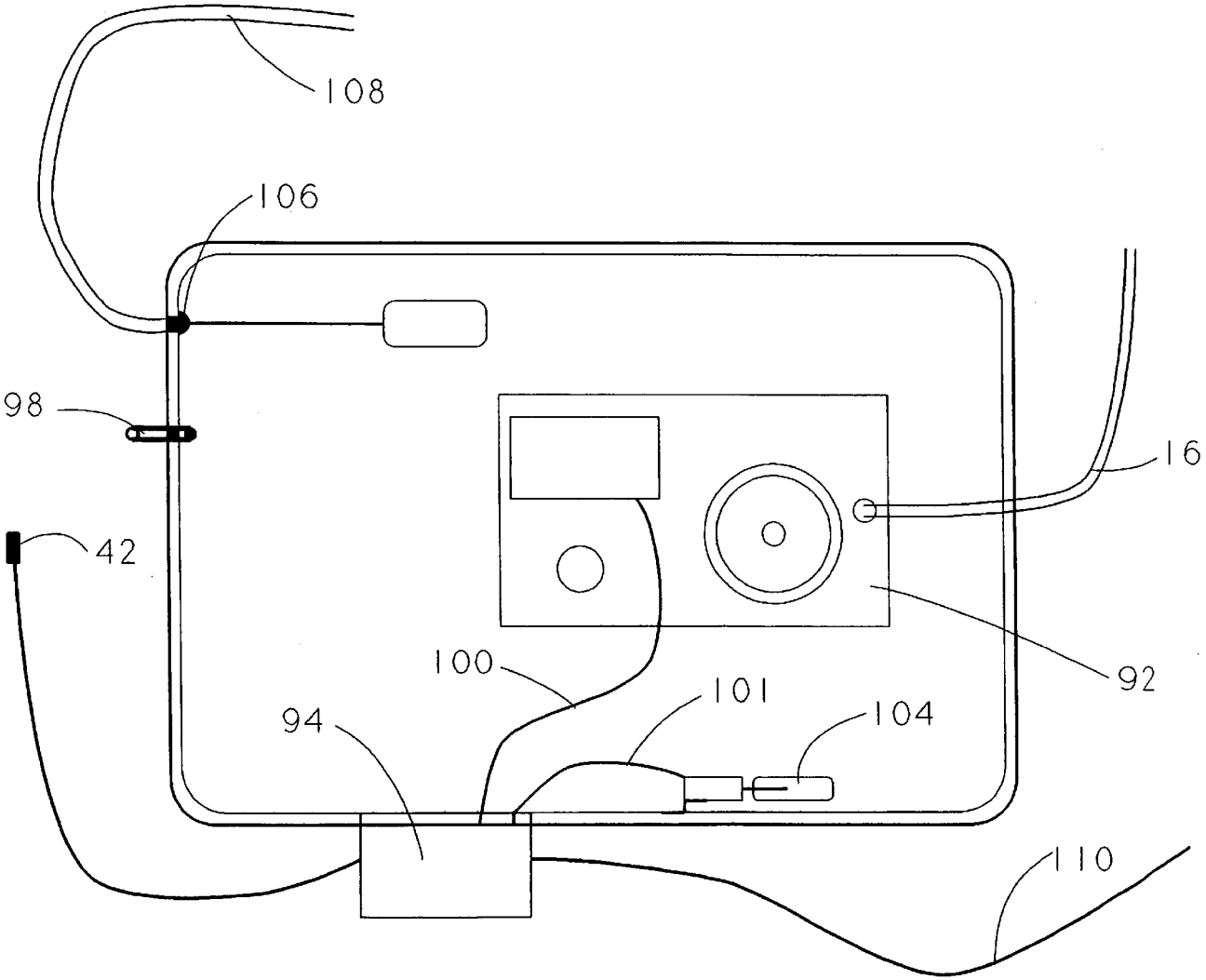
Figure 7C:
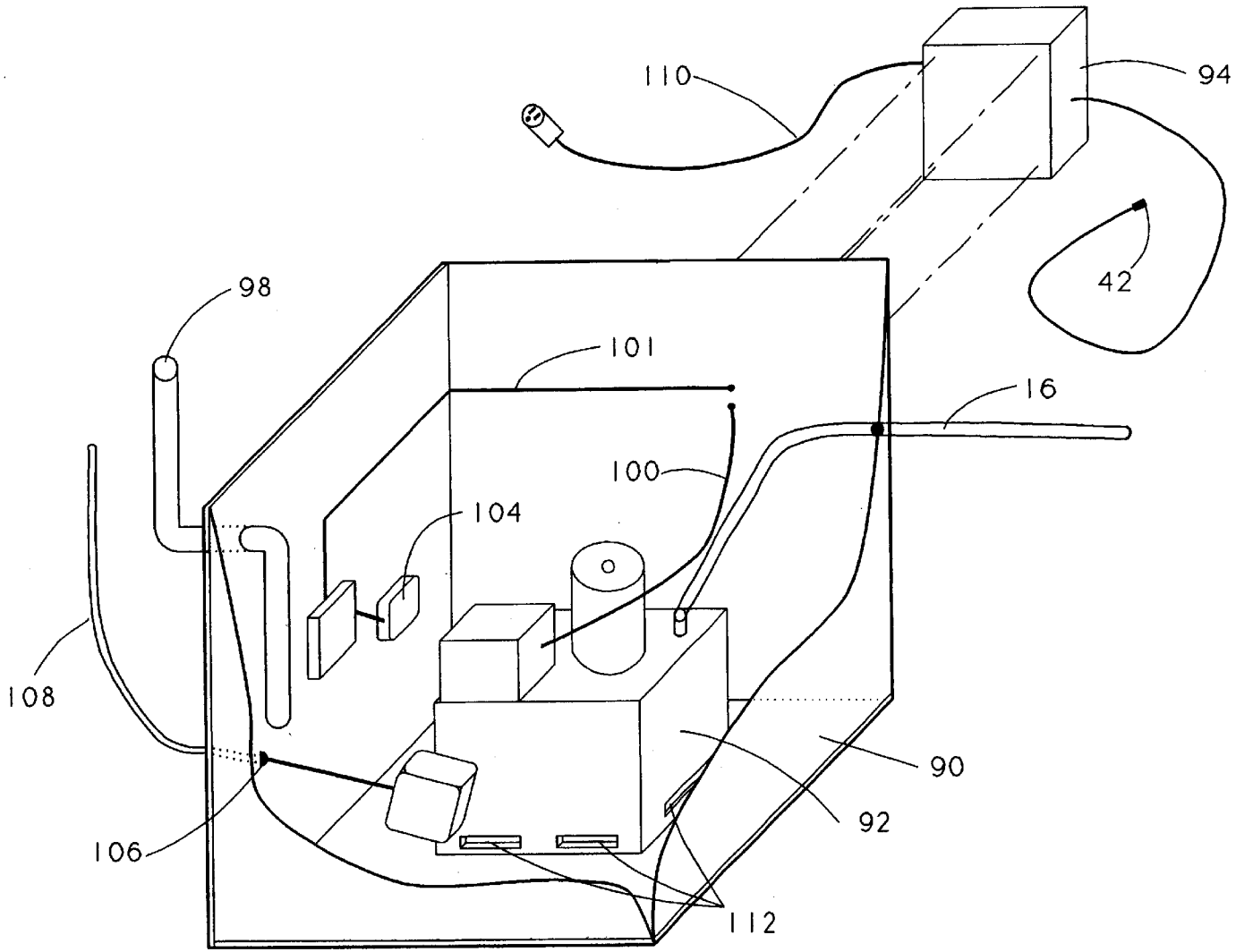

The condensate reservoir 32 and controls for the control system of FIG. 2 are shown in FIG. 7A (side view with reservoir front cutaway), FIG. 7A (front view with reservoir side cutaway) and FIG. 7C (perspective view with reservoir front and side cutaway).

The condensate reservoir tank 90 consists of a plastic tub. A condensate pump 92 is located in the bottom of the reservoir tank 90. The base of the condensate pump 92 has water inlet slots 112 cut into it's base.

Condensate water enters the reservoir tank 92 through inlet tube 98.

Supplement domestic water enters the reservoir 90 through mechanical float valve 106, supplied by a ¼" water supply tube 108 which is attached to a ¼" self tapping valve 34 connected to the building's domestic water supply 35.

A single pole refrigeration control relay 94 is mounted to the exterior of the reservoir tank 90. 110 volt electric power is supplied to the control relay 94 through supply line 110. The control relay's temperature probe 42 is connected to the air conditioner refrigerant liquid line 44. The condensate pump 92 is in electronic communication with the control relay through wiring 100.

A high water level safety float switch 104 is mounted to the interior of the reservoir tank 90 and is in electronic communication with the condensate pump 92 through wiring 101.

Wash water exits the condensate pump 92 and the reservoir tank 90 through polyethylene supply tubing 16.

Figure 8:
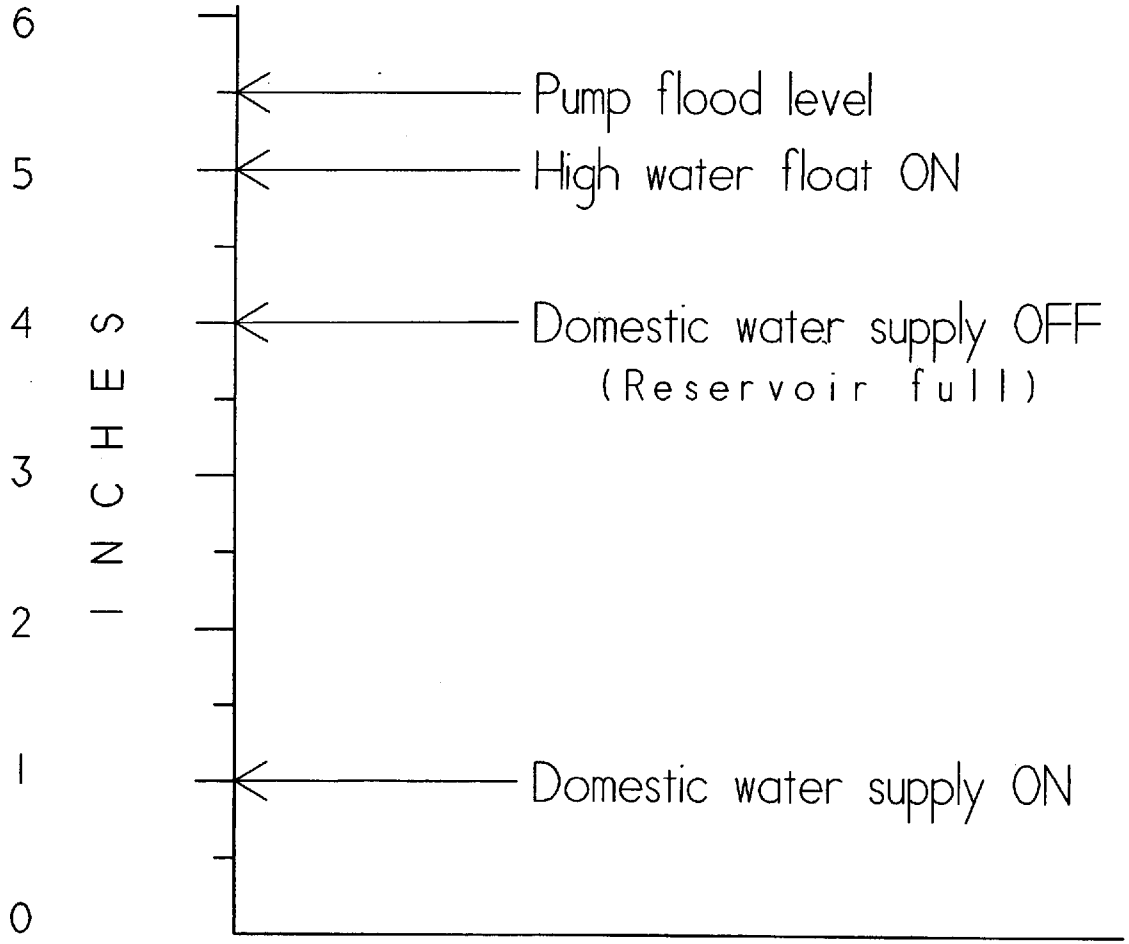
FIG. 8 is a graphic representation of the water level and float switch control points in the system of FIG. 2.

FIG. 8 diagramatically shows the desired water levels in the reservoir tank at which float switches open or close.

Figure 9:
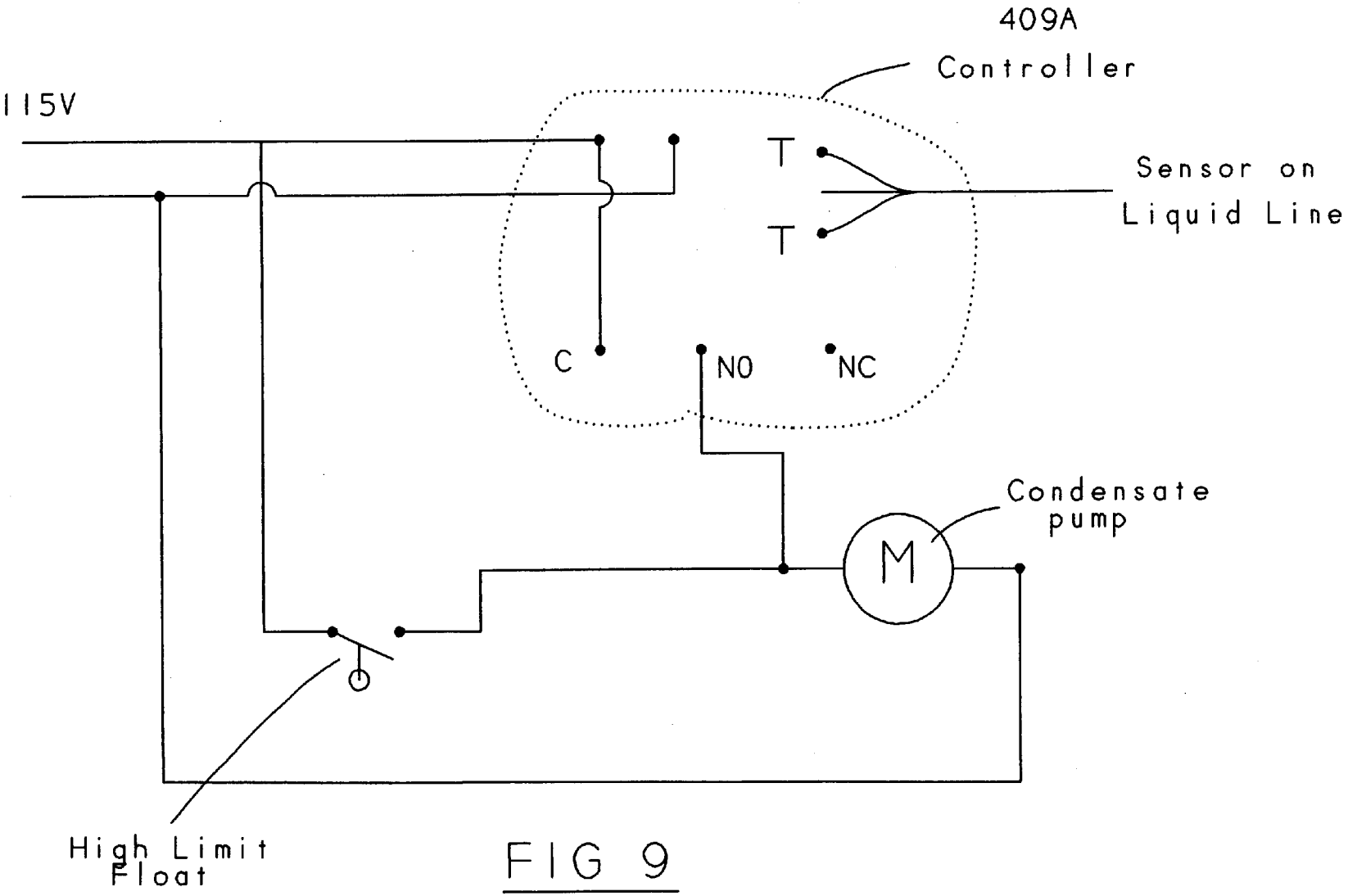
FIG. 9 is a wiring diagram for the system of FIG. 2.

FIG. 9 shows a wiring schematic for the system controls of FIG. 2.

Figure 10:
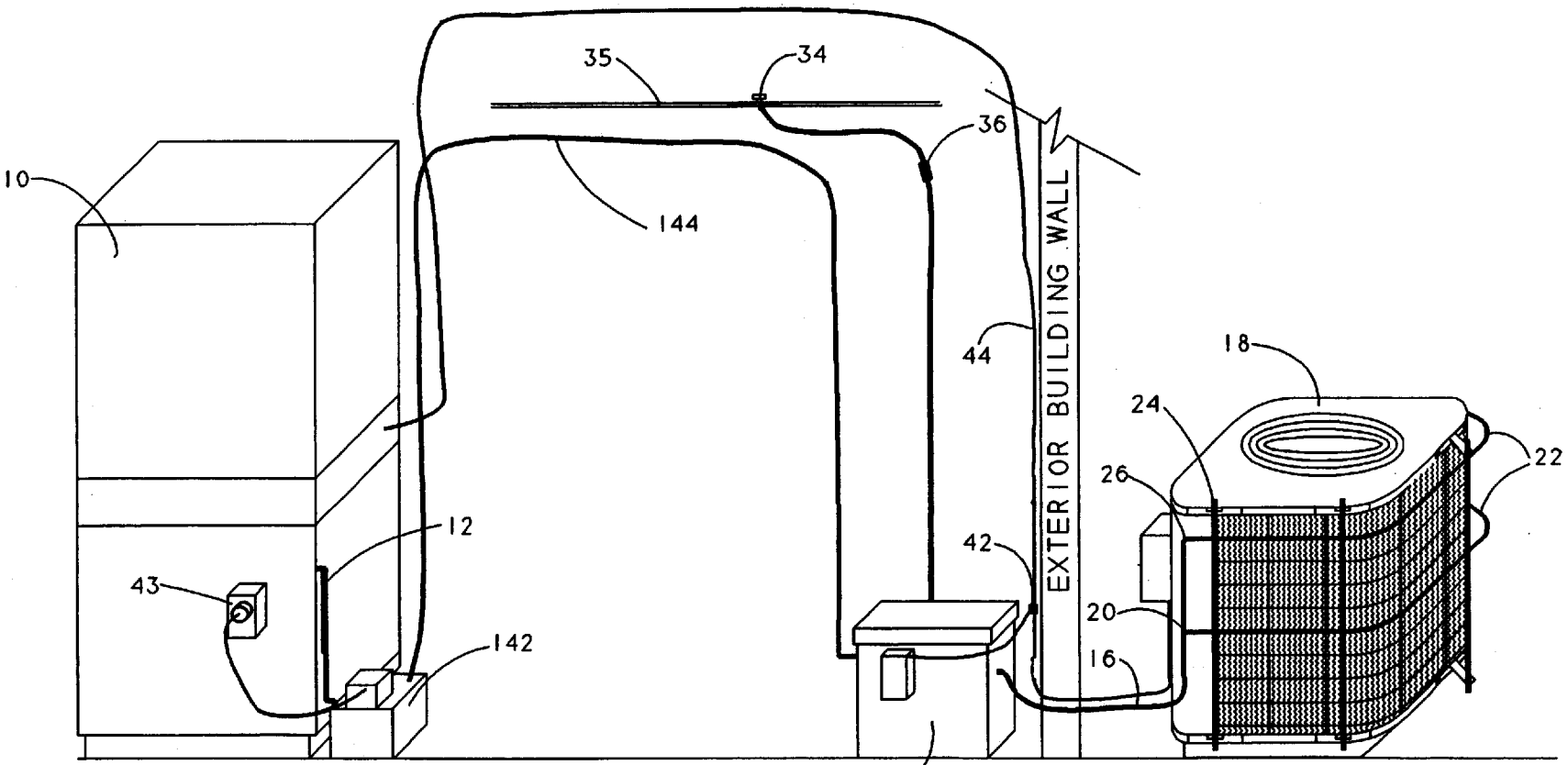
FIG. 10 is an auxiliary supply pump for the system of FIG. 2.

FIG. 10 shows an auxiliary condensate pump 142 used to transfer air conditioner condensate water to the storage reservoir 32. Condensate enters the auxiliary pump 142 through the air conditioner condensate drain 12 and is carried to the storage reservoir 32 in polyethylene supply tube 144.

After condensate water has been sent to the storage reservoir, system of FIG. 2 operates as described above.

From the description above, a number of advantages of the unique apparatus become evident:

(a) because the unit is attached to the air conditioners exterior condenser case and can operate without maintenance personnel present it will increase the frequency of coil cleaning and reduce direct maintenance costs associated with labor;

(b) the system will reduce the power consumed by the compressor over it's life through increased system efficiency and by reduced power consumed by the compressor over it's life due to power reduction during wash cycles;

(c) by following the air conditioner manufacturer's maintenance requirements for the exterior coil unit the usable life of that unit will be increased, forestalling repair and replacement;

(d) by removing the condensate water from the building envelope, air quality inside the building will be improved, and once outside the building the condensate will be applied to the coil, from which it will evaporate which eliminates the problem of standing pools of water and the hazards they pose;

(e) if condensate water is not deposited into a French drain, floor drain or simply onto the roof, it is likely to be disposed of through the building's sanitary waste drain, and while the advantage of reducing this load on the municipal waste treatment is difficult to measure in financial terms, as building codes change to require alternate means of disposal the present invention provides a ready means of compliance;

(f) since the life of an air conditioning system can be 20 years or more, the present invention allows for easy retro-fit installation allowing the building's owner to benefit from increased system efficiency now rather than waiting for a newer, more efficient air conditioner, and (g) the parts and materials used in construction of the present invention are readily available and inexpensive enough that the system pays for itself through the savings and increased efficiencies previously mentioned.

The self-washing coil unit of the present invention uses ⅜" O.D. (¼" I.D.) flexible polyethylene tubing with 1/32" holes drilled (see FIG. 4) at alternating 45 degree angles with 1" spacing. The holes are drilled through one surface of the tubing and are oriented parallel to the main axis of the tubing.

Figure 5A:
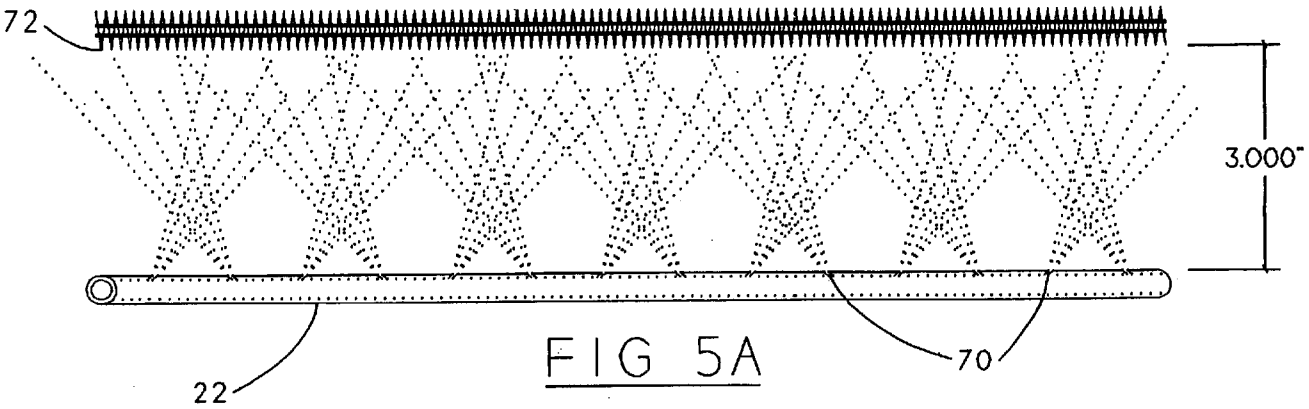
FIGS. 5A and 5B show details spray-flex tubing spray pattern.
Figure 5B:
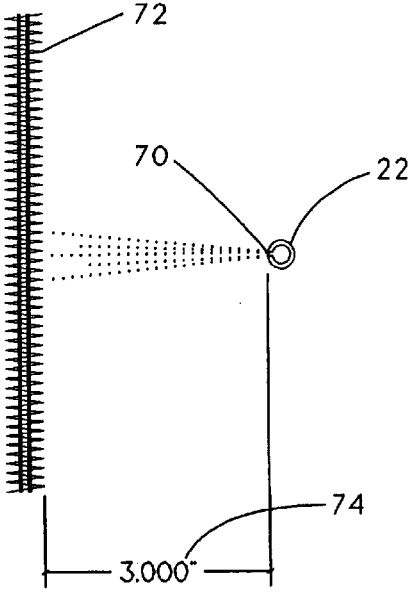

This tubing arrangement delivers a satisfactory spray pattern at a distance of 3" from the tubing (see FIG. 5). The tubing has the advantages of being low cost and flexible enough to eliminate fittings when following the contours of the air conditioner's case. The polyethylene tubing used in its manufacture is UV resistant. Another benefit of this tubing is its relative low cost.

Depending on the height of the air conditioner heat exchange coil more than one row tubing may be required for adequate washing coverage of the fins.

The self-washing coil has three preferred embodiments or levels of functionality. A detailed description of each of their operations is as follows.

The basis system of FIG. 1 applies condensate wash water directly to the heat exchange coil from a condensate pump such as Little Giant Pumps, model:3P732, located near the air conditioner unit inside the building. A wash cycle initiated whenever enough water is collected in the reservoir of the condensate pump to raise an internal float switch.

Condensate will be produced by the air conditioner when it is in operation. Since the volume of condensate water production is a function of relative humidity and the running time of the air conditioning unit, more condensate and therefore more coil washing will occur during conditions when it will be most beneficial. In this way the basic system has a natural self-governing feature.

As condensate water is sprayed onto the heat exchange coil and fins, the impact and downward flow of this water will loosen and carry dirt and debris attached to the coil and fins towards the bottom of the unit. As previously mentioned, multiple rows of spray-flex tubing may be required for adequate wash coverage.

In addition to the cleaning benefit, condensate water applied to the heat exchange coil during operation has been shown to reduce the power demand of the compressor. This reduction in power demand is due to the effect of evaporative cooling at the condenser heat exchange coil. Evaporative cooling is a well known thermodynamic principle. Again, since more condensate and therefore more washing will occur during periods of high air conditioner system load, the evaporative cooling feature of the basic system is also somewhat self-governing.

In the system of FIG. 2, rather than initiating a wash cycle simply because a volume of condensate has been produced, the system attempts to time the wash for a more efficient use of the condensate water.

This system receives condensate water from the air conditioner into a storage reservoir such as a Rubbermaid Rough Tote model 2450, 12" wide×18" long×18" deep, with a volume of 22 gallons. The water storage capacity of this reservoir being larger than that of the basic system allows for a longer and more effective washing of the heat exchange coil.

The condensate is held in the storage reservoir until a control relay senses that the air conditioner is not only running but is under load. This relay has a sensor in contact with the refrigerant liquid line which will heat up as the air conditioner runs. When the temperature of the refrigerant in the liquid line reaches a high or "ON" set point a wash cycle will be initiated. When the temperature of the refrigerant reaches a low or "OFF" set point the wash cycle will be terminated.

The control relay used in this system is a single pole refrigeration control relay with time programmable capabilities such as Johnson Controls A419 Electronic Temperature Control w/Display.

The pump driving the wash cycle resides inside the storage reservoir. It is essentially the same pump used by the basic system but with an internal float disabled and water entry ports cut into its base.

To protect the condensate pump from burn-out due to continuous running (as would be the case in extremely hot, humid weather) a safety feature is needed. The control relay specified allows for the programming of a delay cycle. This feature will allow the condensate pump to run for a predetermined period (15 minutes) before entering the delay cycle. After the delay cycle, if an "ON" condition still exists the pump would resume operation and another delay countdown would start.

The system of FIG. 2 has a supplemental water supply port tied into the domestic water supply for the building. The water supply is controlled by a mechanical float type water inlet valve (example: Watts Regulator brand, model: M1/4FSS) in the reservoir. Float switches of this type are simple, inexpensive and reliable. A back flow prevention device (Cash Acme Valve Corp., type V-14) is installed in the supplemental water supply line to protect the domestic water supply. The supplemental water supply will insure that a wash cycle does not get terminated because of lack of water.

In case of a valve malfunction by the supplemental water supply inlet float valve, a high water float switch (example: Beckett Corporation, model: 1503UR) is employed to protect the pump from a flooding condition inside the reservoir. In the case of a flooding condition (see FIG. 8) this switch would close and signal the pump to start and maintain a wash cycle regardless of refrigerant temperature or delay cycles.

The system of FIG. 2 applies the same, at minimum, the same amount of condensate water that the basic system will, but it will time these applications to maximize the reduction of power consumption by the compressor.

The embodiment of FIG. 3 is for use in conjunction with a municipal utility provider's power management plan.

The spray-flex tubing array is installed as in the systems of FIGS. 1 and 2. Wash water for the system is supplied by direct connection to the domestic water supply and condensate from the air handling unit.

A wash cycle using condensate water is initiated whenever enough water is collected in the reservoir of the condensate pump to raise an internal float switch. The benefits of this wash cycle are the same as described for the system of FIG. 1.

A remotely activated control unit (example: Converge Technologies Inc. Series DCU-S2000 Digital Control Unit) signals the start and stop of another type of wash cycle, a utility wash. This utility wash cycle is for the sole purpose of reducing the A/C units power consumption.

A back flow prevention device is installed in the water supply line to protect the domestic water supply. A flow restriction device may be required to reduce the domestic water pressure to be closer to the water pressure produced by the condensate pump.

A check valve may be used to prevent domestic water from entering the condensate pump during a utility wash.

A large number of air conditioning units fitted with the system would allow a utility provider to reduce the power consumption in a specific or large area during hot conditions. This could be done without disrupting air conditioner operation. The water used would simply evaporate.

Many power distribution utilities employ a power conservation system that remotely triggers a temporary shut down of residential air conditioners during periods of high demand. Typically this occurs during the Summer months when air conditioner use is at a peak.

They initiate a shut down by transmitting a radio signal to a digital control unit connected to the air conditioner. By cycling OFF and ON many air conditioners in different sections of their service area, the utility provider can reduce the total power demand for their entire service area. This procedure is commonly know as "rolling brown-outs".

Recently local utility providers have received public criticism regarding this policy, which can shut off a residential utility customer's air conditioner during conditions when it is needed most. Specific concerns regarding customers with respiratory health problems were raised.

If installed and controlled in similar fashion as the "rolling brown-out" system, the system of FIG. 3 could temporarily reduce the power consumption of air conditioners in a defined area without interrupting service. Use of this system provides an immediate reduction in power consumption by the air conditioner compressor of 1.5 to 2.0 Amps, or in the case of the tested unit a 10% to 13% power savings.

The self-washing coil of this invention increases the life of an air conditioner, reduces maintenance costs as well as power consumed by the air conditioner over it's life. The invention is inexpensive to manufacture and is easily adapted to most air conditioning units, both residential and commercial.

Secondary benefits such as reduced exposure to mold spores inside the home, reduced municipal waste water and removing breeding grounds for harmful insects are difficult to attribute a dollar amount but are nonetheless real benefits that use of the present invention will produce.

While the above description contains may specifications, these should not be construed as limitations on the scope of the invention, but rather as an exemplification of some of its preferred embodiments. Many other variations are possible such as indicated below.

The addition of a schedule timer that would initiate wash cycles independent of the air conditioner's activity. This would be of particular use in an industrial setting such as the paper industry, where a thorough washing of the coil before start-up would be beneficial. It would also insure coil cleaning even during periods of low system use/load.

The collection and storage of alternative sources of clean wash water (rain water, sump pump discharge water, etc.) that would normally be considered waste water. A system of this type would be of particular use in more arid areas.

The spray-flex tubing could be adapted for inclusion in the manufacture of the air conditioner's exterior unit. This would allow for coil washing from either side.

Installing spray-flex tubing inside the air conditioner at the evaporator. This would allow a biodegradable coil cleaning solution to be applied to the evaporator to remove dust and mold build-up on the interior side of the air conditioner. After washing the evaporator the cleaning solution would follow the path of condensate and eventually be applied to the exterior coil.

In a situation where more condensate is being collected than the self-washing coil system requires, a diverter valve could redirect clean wash water to ornamental landscape plants. Another use for clean wash water could be to supply water to other building functions that don't require potable water, example: toilet tanks.

The embodiment of FIG. 3 uses condensate water for washing. A system strictly designed for control by a utility provider could eliminate the handling of condensate water and only deal with immediate power reduction. In a case like this the removal and disposal of condensate water would have to be dealt with separately.

A combination of the systems of FIGS. 2 and 3 is also possible. Since remote wash of FIG. 3 would only be triggered during a period of high regional power demand, the system of FIG. 2 would provide power savings and cleaning benefits the rest of the time. Such a hybrid system would most likely deposit the domestic supply water into the storage reservoir and allow high water level float sensor to activate the pump.

The use of a refrigerant pressure sensing relay instead of a refrigerant temperature sensing relay. This type (Johnson Controls, Penn Control P70) of relay is standard in the industry and would be tied into the gauge service port which is a standard fixture on commercially available air conditioning units.

Different configuration of the spray-flex tubing could be used to achieve different flow rates and spray patterns.

A cleaning agent disbursement system could easily be incorporated either using a delivery timer or a time release formula.

The attachment assembly described in the preferred embodiments works well with most residential air conditioners. However, different case designs would require different attachment brackets, clamps, etc. Commercial air conditioners would certainly require different attachment mechanisms.

In the system of the present invention, the water supply may simply comprise a domestic water supply (i.e. tap water under pressure) for supplying water to the spray heads. In such arrangements the condensate may then be disposed of elsewhere.

We claim:

1. An air conditioning system including an exterior condenser having a heat exchange coil, a water supply, spray head means on the condenser for spraying water from the water supply onto the heat exchange coil, and control means for periodically energizing the water supply whereby water is supplied to the spray head means and onto the exchange coil to clean and cool the coil, and wherein the control means includes means for sensing that the air conditioning system is not only running but is under load, and means for initiating a spray of water onto the heat exchange coil when a predetermined load is sensed, and wherein the control means includes a remotely activated control unit for initiating a spray of water onto the heat exchange coil from a remote location to thereby reduce power consumption of the system.

2. An air conditioning system as in claim 1 wherein the spray head means includes flexible tubing with discharge openings therein for directing water onto the exchange coil.

3. An air conditioning system as in claim 2 wherein flexible tubing extends around the condenser at a plurality of different elevations.

4. An air conditioning system as in claim 1 including an interior evaporator having a condensate drain, and wherein the water supply comprises a condensate reservoir and pump assembly and conduit for delivery of condensate from the drain to the reservoir and pump assembly, and wherein the control means periodically energizes the pump whereby condensate in the reservoir is pumped to the spray head means and onto the exchange coil to clean and cool the coil.

5. An air conditioning system as in claim 4 including a supplemental water supply connected to the reservoir for adding water thereto.

6. An air conditioning system as in claim 5 wherein the control means also functions to control the flow of water from the supplemental supply to the reservoir.

7. An air conditioning system as in claim 1 wherein the water supply comprises tap water under pressure.

* * * * *